United States Patent [19]

Ranalli

[11] 4,382,254

[45] May 3, 1983

[54] VIDEO DISPLAY CONTROL CIRCUITRY

[75] Inventor: Charles Ranalli, Burlington, Mass.

[73] Assignee: Nixdorf Computer Corporation, Burlington, Mass.

[21] Appl. No.: 160,696

[22] Filed: Jun. 18, 1980

[51] Int. Cl.[3] ..... G09G 1/14

[52] U.S. Cl. ..... 340/744; 315/367; 315/383; 340/767; 340/793

[58] Field of Search ..... 340/793, 767, 744; 315/367, 383; 358/168, 241

[56] References Cited

U.S. PATENT DOCUMENTS

| | | | |
|---|---|---|---|
| 3,527,980 | 9/1970 | Robichand et al. | 315/367 |
| 4,086,579 | 4/1978 | Easter | 340/722 |
| 4,177,409 | 12/1979 | Chamberlin | 315/383 |
| 4,251,755 | 2/1981 | Bryden | 340/793 X |
| 4,274,094 | 6/1981 | Noguchi | 340/793 X |

*Primary Examiner*—David L. Trafton

*Attorney, Agent, or Firm*—Krass, Young & Schivley

[57] ABSTRACT

A multilevel video display control circuit. A plurality of current levels are developed in response to coded command signals (P1, P2, P3). The generated currents are summed together and converted to analog voltage signals (V25) to control the brightness of the pixels on the display. A contrast adjustment network (26) includes a first potentiometer (K1) for setting the magnitude of one of the currents at a desired level. A second potentiometer (K2) is provided for varying the magnitudes of the other current levels while maintaining the first current at the preset magnitude. Preferably, the magnitude of the first current is inversely varied with respect to other current levels.

9 Claims, 3 Drawing Figures

VIDEO DISPLAY CONTROL CIRCUITRY

DESCRIPTION

1. Technical Field

This invention relates generally to video display devices and, more particularly, to multilevel contrast control circuits for such devices.

2. Background Art

Video displays are finding increasing usage in text editing applications in word processing systems. In these kinds of applications it is desirable to provide several different levels of brightness for the dots or pixels making up the characters on the display. In those systems which use three or more levels of brightness, the contrast between each level is extremely important in order for the user to differentiate between the different intensities. Provision also must be made for adjusting the contrast and brightness of the display to accommodate various lighting conditions.

Some of the known video display circuits utilize separate current generator circuits, each one solely providing the necessary current magnitude to generate its associated video level. This approach requires high switching speeds to turn one circuit off while another circuit is turned on. Unfortunately, there is often a considerable amount of overlap during the switching transitions. This results in undesirable distortion or fringe effects along the edges of the displayed characters.

Most of the display control circuits heretofore known include separate adjustment mechanisms for varying each video level. Normally, the adjustment mechanisms comprise potentiometers which are user accessible by way of knobs on the control panel of the display. For example, there would be one knob for the dim video level, one for the medium video level, and one for the bright video level. While this gives a good deal of flexibility to the system, it also increases the chances of erroneous adjustments being made such that the display does not function to differentiate between the different video levels. Moreover, the relatively large number of adjustments further increases manufacturing costs.

The present invention is directed to overcoming one or more of the problems as set forth above.

Disclosure of the Invention

The broad concept of the present invention revolves around the generation of different brightness levels by way of summing together currents developed by various current generators, one of which is continuously energized so as to reduce the fringing effects caused by prior art switching techniques. The continuously energized generator conveniently may serve the dual purpose providing the only current for developing the dim video level and also a component of the current for developing the brighter levels which is added to the current provided by another generator.

In one aspect of the present invention, a multilevel contrast control circuit for a video display is provided which includes first, second and third generator means for developing three different current levels in response to different command signals. A contrast adjustment network includes a first means for setting the magnitude of the first current at a desired level. Second means is provided for varying the magnitude of said second and third currents while maintaining said first current at the desired level. Output means provides selected voltage levels to control the brightness of the dots on the video display as a function of the sum of the current magnitudes developed by the first, second and third circuits. The brighter video levels are derived by a combination of the second or third currents with the first current which is continuously generated for each dot. Fringe effects are thus substantially eliminated. Preferably, the first means is operative to inversely vary the magnitude of the first current with respect to the second and third currents to permit a full range of contrast without distortion.

BRIEF DESCRIPTION OF THE DRAWINGS

Other objects and advantages of the present invention will become apparent upon reading the following specification and by reference to the drawings in which.

BEST MODE FOR CARRYING OUT THE INVENTION

Figure 1:
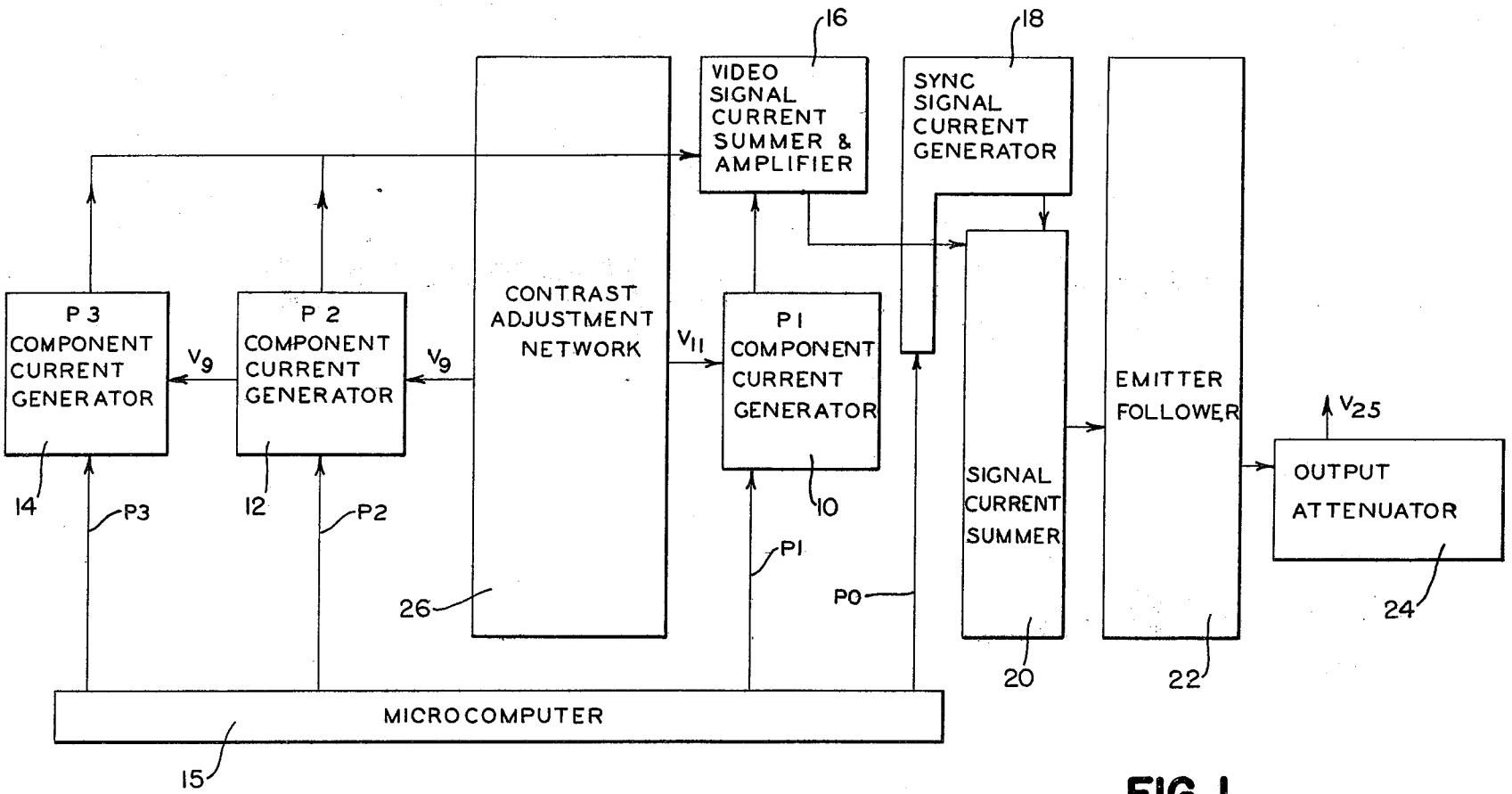
FIG. 1 is a block diagram of the preferred embodiment of the present invention.

Referring to FIG. 1, the preferred embodiment of the invention utilizes a first current generator 10, a second current generator 12, and a third current generator 14 to develop three discrete current levels in response in input command signals P1, P2, and P3, respectively. The input command signals are derived from a microcomputer based controller 15 which provides digital signal levels on the P1, P2, and P3 input lines depending upon the video level or brightness desired for each dot on the display.

The outputs of current generators 10, 12, and 14 are summed together and amplified by circuitry 16. A sync signal current generator 18 utilizes a synchronization signal PO from controller 15 to generate a current level adapted for synchronizing the video display. The outputs of generator 18 and circuit 16 are summed together by summing circuit 20 which forms a voltage at the its output which is proportional to the current summation. An emitter follower network 22 produces at its output a replica of the voltage at its input, enchanced by impedence level reduction. The output of emitter follower circuit 22 is connected to the display through an output attenuator network 24. Network 24 serves to minimize transmission line reflections in a manner known in the art. The output V25 is an analog video signal generated by the circuitry of the present invention to provide a monochrome cathode ray tube (CRT) data display with up to three levels of character intensity in EIARS170 composite video/sync format.

Contrast adjustment network 26 operates to vary the magnitude of the current levels generated by current generators 10, 12 and 14 such that the contrast between the different video levels may be easily adjusted using a minimum number of components.

Figure 2:
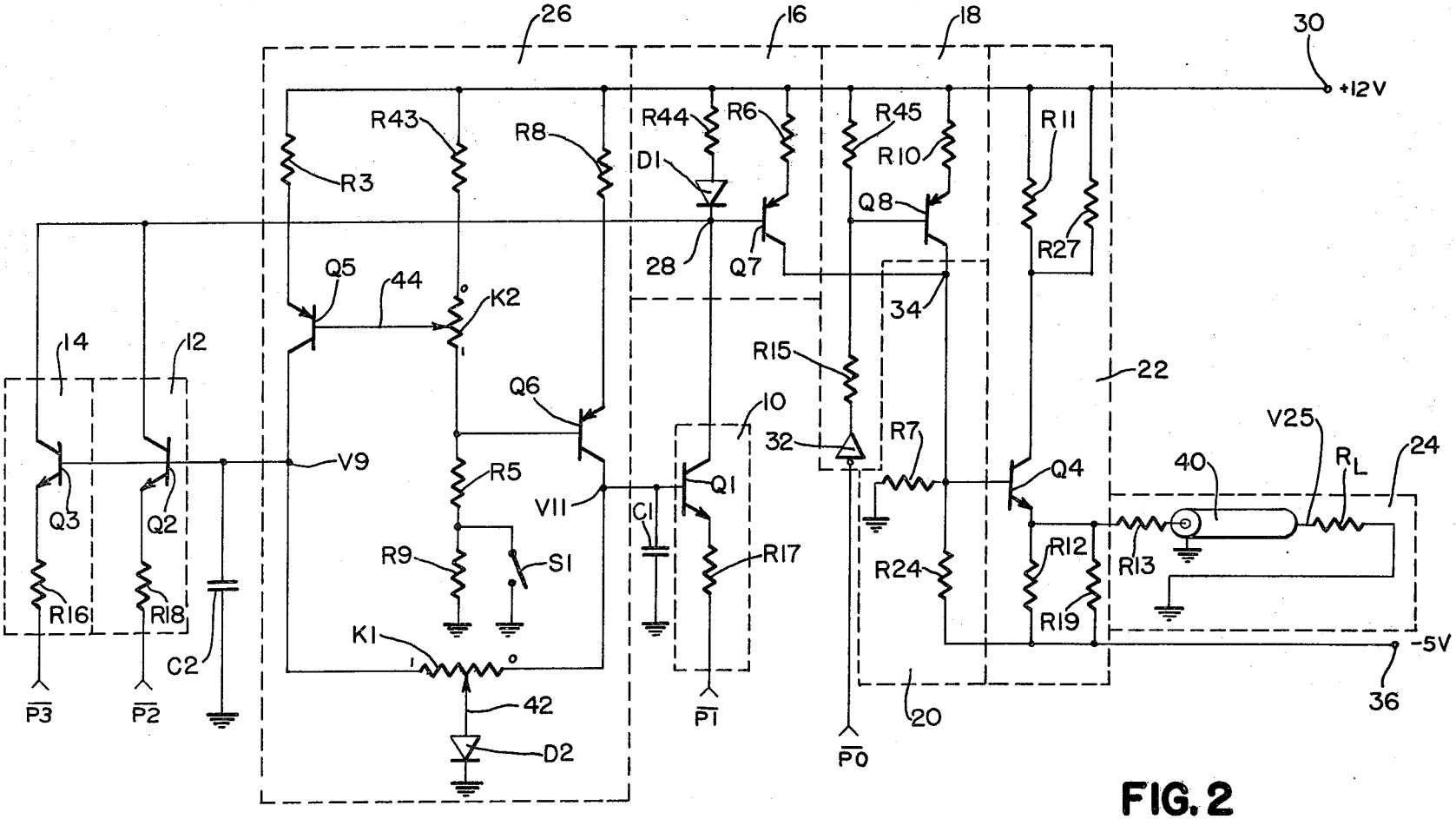
FIG. 2 is a schematic diagram showing the circuit details of the preferred embodiment.

Referring now to FIG. 2, the components making up the functional blocks shown in FIG. 1 are generally encompassed by dotted lines to aid the reader in ascertaining the correspondence between the two figures. Current generator 10 includes an NPN transistor Q1 having resistor R17 coupled between the emitter and the P1 input. Similarly, generators 12 and 14 include NPN transistors Q2, Q3 and resistors R18, R16 coupled to command inputs P2, P3, respectively.

The collectors of transistors Q1, Q2, and Q3 are connected to a summing junction node 28 in circuitry 16. Node 28 is connected to the base of PNP transistor Q7. Resistor R6 is connected between a +12 volt voltage source 30 and the emitter of transistor Q7. Series connected resistor 44 and diode D1 are coupled between source 30 and the base of transistor Q7.

A synchronization pulse P0 is inverted by inverter 32 and fed to the base of PNP transistor Q8 in the sync signal current generator 18 through resistor R15. Resistors R45 and R10 are connected between the base and emitter of transistor Q8, respectively, and voltage source 30.

The collectors of transistors Q7 and Q8 are connected together at node 34 in signal current summer circuit 20. Resistors R7 and R24 provide a voltage divider network connected to the base of NPN transistor Q4 in emitter follower circuit 22. A parallel coupled resistor network comprised of resistors R11 and R27 are connected between the collector of transistor Q4 and voltage source 30. A parallel coupled resistor network made up of resistors R12 and R19 are connected between the emitter of resistor Q4 and a −5 volt source 36.

Attenuator network 24 includes an impedance represented by resistor R13 which matches the impedance RL presented by the load, here the video display. A coaxial cable 40 connects the output of the display generator circuitry to the video display, with the analog voltage developed at V25 being utilized by the display to generate the intensity levels of the dot patterns or pixels on the display. Examples of such video displays are Zenith Model DT2 and Motorola model M3000.

The contrast adjustment network 26 serves to vary the magnitude of the current levels generated by generators 10, 12 and 14. A dim video level adjustment potentiometer K1 has its opposite ends connected to the bases of transistor Q1 and transistors Q2, Q3, respectively. Note that the bases of transistors Q2, Q3 are connected together. The wiper 42 of potentiometer K1 is connected to ground through diode D2. PNP transistors Q5 and Q6 provide current sources for supplying current to the segments of potentiometer K1 divided by the setting of wiper 42. The base of transistor Q5 is connected to the wiper of potentiometer K2. One end of potentiometer K2 is connected to the voltage source 30 through resistor R43. The other end of potentiometer K2 is connected to ground through resistors R5 and R9. Full contrast range switch S1 serves to short circuit resistor R9 when closed. Resistor R3 is connected between the emitter of transistor Q5 and source 30. Likewise, resistor R8 is connected between the emitter of transistor Q6 and source 30. The voltage developed at nodes V9 and V11 define the base and emitter voltages of transistors Q2, Q3, and transistor Q1, respectively. Capacitors C1 and C2 coupled to nodes V11 and V9, respectively, provide filtering functions as known in the art. As will be more fully discussed under the following heading, contrast adjustment network 26 provides a wide range of contrast between three different video levels: dim video level (DVL), medium video level (MVL), and bright video level (BVL).

Industrial Applicability

The present invention finds particular utility with video displays used for text editing purposes in word processing systems. However, it should be understood that the circuit of the present invention may also be used in a variety of video display applications in which multiple levels of dot brightness are desired.

The setting of potentiometer K1 determines the brightness level of the dim video level. Potentiometer K1 is preferably factory adjustable and not accessible to the user in the field, e.g., it may be located on a circuit board within a housing. The two segments of potentiometer K1 provide inversely varying base voltages to transistor Q1 and transistors Q2, Q3. Typically, the manufacturing personnel will adjust the setting of potentiometer K1 such that the dim video level characters are displayed at the minimum level which an operator can effectively use. A dim video level dot is generated by a digital signal from controller 15 on line P1 which forward biases the base and emitter junction of transistor Q1. The current level generated at the collector of transistor Q1 is converted to a given voltage level by the emitter follower circuit 22 which will cause the dot to glow in proportion to the generated voltage. The ultimately developed brightness level is thus a function of the amount of resistance in the right segment of potentiometer K1. Note that the adjustment of potentiometer K1 is the sole determinant of the brightness level of the dim video level characters.

Potentiometer K2 is preferably accessible to the user such that the contrast levels between the various degrees of brightness on the display can be adjusted to user preference. The setting of potentiomter K2, however, has no effect on the dim video level. The base voltage V9 to transistors Q2 and Q3 will vary as a function of the amount of current flowing through the left segment of potentiometer K1. The current level is a function of the setting of potentiometer K2 which controls the base and emitter voltages of transistor Q5. Potentiometer K2 operates to simultaneously vary the magnitudes of the currents generated in the current generators 12 and 14, to the exclusion of generator 10.

The voltage at node V9 defines the base and emitter voltages for transistors Q2 and Q3 when energized by command signals P2 and P3, respectively. As with command signal P1, the polarity of signals P2, P3 are such that their respective transistors are energized in response thereto. The magnitude of the current ultimately generated by the current generators 10, 12, 14 is a function of the emitter voltages and the values of the resistances in their respective circuits. In the preferred embodiment, resistor R16 has a value of 220 ohms, R17 a value of 220 ohms, and R18 a value of 430 ohms.

It is important to realize that the actual voltages developed for the bright and medium video levels are derived by summing the current generated by generator 12 (for MVL) or generator 14 (for BVL) with the current provided by generator 10 for DVL. In other words, current generator 10 is always providing current for generating at least one component of the ultimate video signal. This prevents glitching or fringing effects which would be encountered if each current generator 10, 12 and 14 were solely responsible for providing its associated video signal. Such nonuniform display attributes are often found in prior art systems during the transitional period between one generator turning on and another one turning off.

Figure 3:
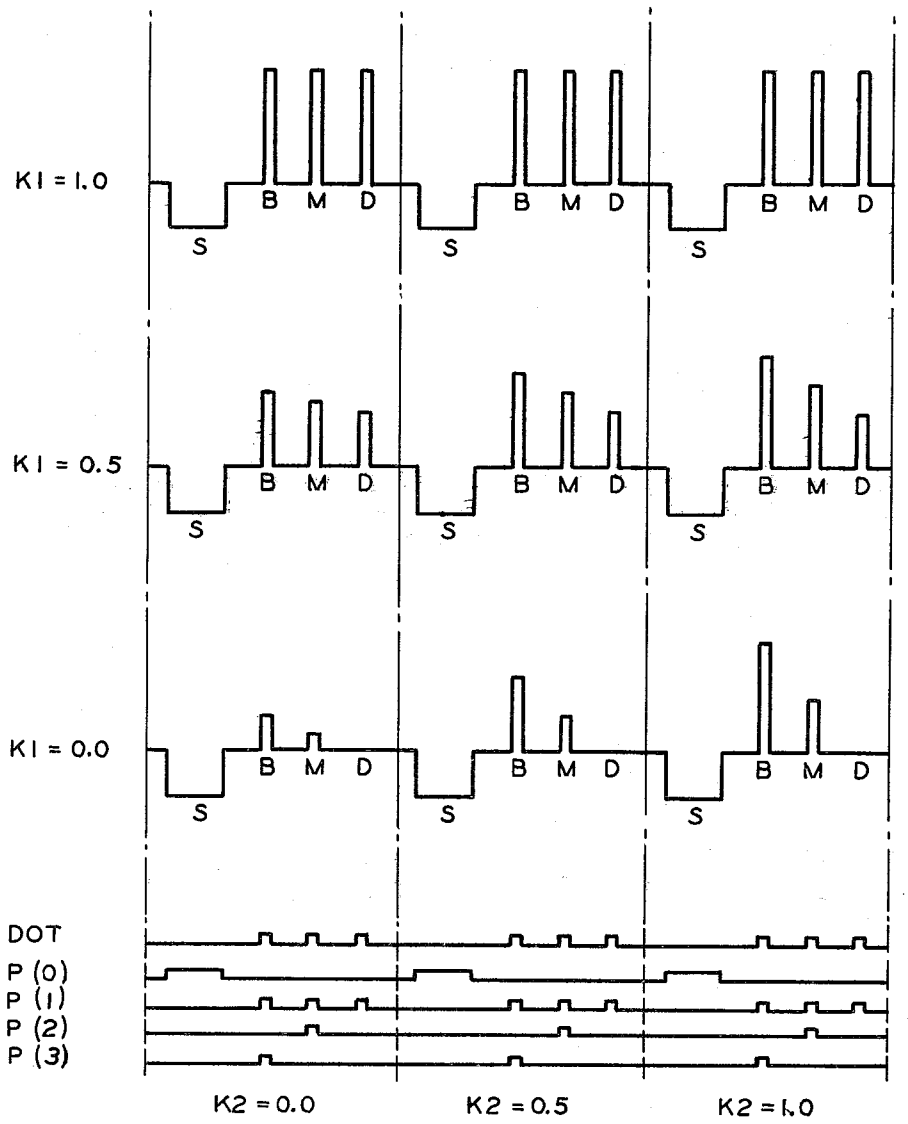
FIG. 3 is a chart showing various voltage levels developed by the circuitry of the preferred embodiment.

FIG. 3 is a chart showing the effect of the video level signals provided at V25 as a function of the settings of potentiometers K1 and K2. The numbers associated with potentiometers K1 and K2 in FIG. 3 corresponds with the notations on either end of the potentiometers in FIG. 2. It can be seen that the extreme settings of 1.0 and 0.0 of potentiometer K1 are not preferred in actual use but are merely shown to illustrate the full range of the effects of the settings of the potentiometer. The waveform diagram on the lower portions of FIG. 3 illustrates the relationship between the command signals P1, P2, and P3 with respect to the video levels ultimately generated by the circuitry. Controller 15 transmits the command signals as selected digital codes in which the P1 command signal is always used to generate dots on the display at the appropriate time defined by the signal labeled DOT. The P0 command is used to synchronize the scanning of the display prior to generating any dots for a particular line. It is important to note that for any value of potentiometer K1 (besides 1.0) that reducing the value of potentiometer K2 has the effect of decreasing the bright and medium video levels without affecting the dim video level. This is significant in that the operator adjustments to the contrast control potentiometer K2 cannot alter the preset setting of the dim video level character intensity. The inversely varying relationship between the two brighter video levels and the dim level as a function of potentiometer K1 is also advantageous to prevent distortion at the higher levels. But for this relationship it might be possible to adjust the brightness of the dim level to such a high intensity that undesirable distortion or blooming would occur at the brighter levels when the current components from the other generators were added to the dim current level.

It is a feature of this invention that a full contrast range switch S1 is provided for modifying the maximum voltage excursion of the video level signal to accomodate different types of displays. For example, the aforementioned Zenith display may tolerate a certain maximum voltage before distortion occurs, whereas the Motorola display is designed to utilize a different maximum voltage for full contrast. Closing switch S1 short circuits resistor R9 thereby dropping the base voltage to transistors Q5 and Q6. This, in turn, uniformly increases the base voltage to transistors Q1, Q2 and Q3 to increase the current magnitudes and thus the maximum voltage developed thereby. Accordingly, the circuitry of the present invention can be utilized in conjunction with a wide variety of displays.

In view of the foregoing, it can now be realized that the present invention provides substantial improvements of known video display generator systems. The number of adjustments are kept to a minimum thereby decreasing manufacturing costs. Moreover, the limited number of adjustments available to the user reduces the possibility of the operator inadvertantly disturbing the accuracy of the initial set up. However, at the same time, the disclosed circuitry enables a wide range of contrast levels which can be varied by the user to accomodate different lighting and application factors. Additionally, the method by which the various video display levels are generated increases the accuracy of the display and substantially eliminates visible fringes along the edges of displayed characters.

It should be understood that while this invention was described in connection with a particular example thereof, various modifications will become apparent to one skilled in the art upon reading the above specification. One such modification would be the substitution of fixed resistors for each segment of potentiometer K1. This would fix the dim video level at a particular intensity. Accordingly, factory adjustment of the DVL level would not be needed thereby reducing labor costs although somewhat to the detriment of circuit flexibility. However, in high volume production or where the user environment is well established, the adjustment of the dim video level may not be required. Other aspects, objects and advantages of this invention can be obtained from a study of the drawings, the disclosure and the appended claims.

I claim:

1. Multilevel video display circuitry comprising:
first circuit means (10) for developing a first current in response to a first command signal (P1);
second circuit means (12) for developing a second current in response to a second command signal (P2);
third circuit means (14) for developing a third current in response to a third command signal (P3);
summing means (28) coupled to the outputs of said first, second, and third circuits for summing the currents developed thereby;
output means (22) for providing selected voltage levels to control the brightness of dots on the video display as a function of the output of the summing means; and
contrast adjustment network means (26) including first means (K1) for setting the magnitude of the first current at a desired dim but visible level by varying the first current and simultaneously inversely varying said second and third currents, and second means (K2) for varying the magnitude of said second and third currents while maintaining said first current at said desired level.

2. The circuitry of claim 1 wherein said first (10), second (12), and third (14) circuit means each include a transistor (Q1, Q2, Q3) for providing current magnitudes as a function of voltage levels applied to inputs thereof.

3. The circuitry of claim 2 wherein said first means in the contrast adjustment network (26) includes a first potentiometer (K1) having one end thereof coupled to an input of the transistor (Q1) in the first circuit means (10) and the opposite end thereof being coupled to the inputs of said transistors (Q2, Q3) in the second (12) and third (14) circuit means, said potentiometer having a wiper (42) connected to substantially ground level.

4. The circuitry of claim 3 wherein said contrast adjustment network (26) includes:
a first current source (Q6) for delivering current to said one end of the first potentiometer (K1);
a second current source (Q5) for delivering current to the other end of said first potentiometer (K1); and
means (K2) for adjusting the magnitude of current delivered by said second current source (Q5).

5. The circuitry of claim 4 wherein said first current source includes a transistor (Q6) having an input coupled to a voltage source (30) and an output coupled to said one end of said first potentiometer (K1); and wherein said second current source includes a transistor (Q5) having an input coupled to said voltage source (30) and an output coupled to the other end of said potentiometer (K1).

6. The circuitry of claim 5 wherein said means for varying the second current source includes a second potentiometer (K2) having one end connected to said voltage source (30), and a wiper (44) connected to the input of said second transistor (Q5).

7. The circuitry of claim 6 wherein said contrast adjustment network (26) further includes a resistive network (R5, R9) connected between the inputs of said transistors (Q5, Q6) and substantially ground level; and switch means (S1) for selectively shorting at least a portion of said resistive network to ground.

8. The circuitry of claim 1 which includes controller means (15) for transmitting said command signals (P1, P2, P3) as a plurality of digital codes in which the first command signal (P1) is substantially always used to generate dots on the display; said output means providing a dim video level analog voltage in response to a first code (P1), a medium video level analog voltage in response to a second code (P1, P2), and a bright video level analog voltage in response to a third code (P1, P3).

9. A method of generating and adjusting the contrast of multilevels of video display signals, said method comprising:

generating a first brightness level on a video display from a first current generating circuit;

generating a second brightness level on the video display from a summation of currents from the first circuit and a second current generating circuit;

initially setting the first brightness level to a dim but visible level on the display by varying the current from the first circuit and simultaneously inversely varying the current from the second circuit; and thereafter, adjusting the current from the second circuit to adjust the brightness of the second level while maintaining the current from the first circuit at the previously adjusted level.

* * * * *